United States Patent [19]

Mari

[11] Patent Number: 4,949,495

[45] Date of Patent: Aug. 21, 1990

[54] AUTOMATIC DEVICE FOR THE INTRODUCTION OF CARTRIDGES IN ARM MAGAZINES

[76] Inventor: Marco Mari, Via IV Novembre, 31, Paderno Ponchielli, Italy

[21] Appl. No.: 193,653

[22] PCT Filed: Nov. 27, 1986

[86] PCT No.: PCT/IT86/00087

§ 371 Date: Mar. 28, 1988

§ 102(e) Date: Mar. 28, 1988

[87] PCT Pub. No.: WO88/01042

PCT Pub. Date: Feb. 11, 1988

[30] Foreign Application Priority Data

Aug. 6, 1986 [IT] Italy ..... 48363 A/86

[51] Int. Cl.[5] ..... F41A 9/83

[52] U.S. Cl. ..... 42/87

[58] Field of Search ..... 42/87, 88, 90

[56] References Cited

U.S. PATENT DOCUMENTS

| | | | |
|---|---|---|---|
| 1,355,684 | 10/1920 | Northover | 42/87 |
| 1,786,537 | 12/1930 | Holek | 42/87 |
| 2,362,109 | 11/1914 | Whitmore | 86/47 |
| 2,451,521 | 10/1948 | Uglum | 42/87 |
| 2,531,387 | 11/1950 | Bilodeau | 86/46 |
| 2,659,263 | 11/1953 | Costello | 86/47 |
| 2,981,024 | 4/1961 | Skoff | 42/87 |
| 3,526,028 | 9/1970 | Winch | 29/200 |
| 4,574,511 | 3/1986 | Csonger | 42/87 |
| 4,706,402 | 11/1987 | Csonger | 42/87 |
| 4,739,572 | 4/1988 | Brandenberg | 42/87 |

FOREIGN PATENT DOCUMENTS

| | | | |
|---|---|---|---|
| 416085 | 7/1936 | Belgium . | |
| 86041 | 8/1920 | Switzerland . | |
| 379179 | 8/1932 | United Kingdom | 42/88 |
| 8503119 | 7/1985 | World Int. Prop. O. . | |

*Primary Examiner*—Charles T. Jordan

*Attorney, Agent, or Firm*—Beveridge, DeGrandi & Weilacher

[57] ABSTRACT

An automatic device with interchangeable interface for the introduction of cartridges in the bifilar or monofilar magazines of automatic and semi-automatic arms, comprising a plate (1) with a cartridge-guide ledge (2), placed above a vertical track (3) for transferring said cartridges into a suitable seat (18) from which a piston (13) introduces the same, one by one, into an arm magazine by means for a movable pin (10) provided in such a way that it may bend at right angle.

8 Claims, 5 Drawing Sheets

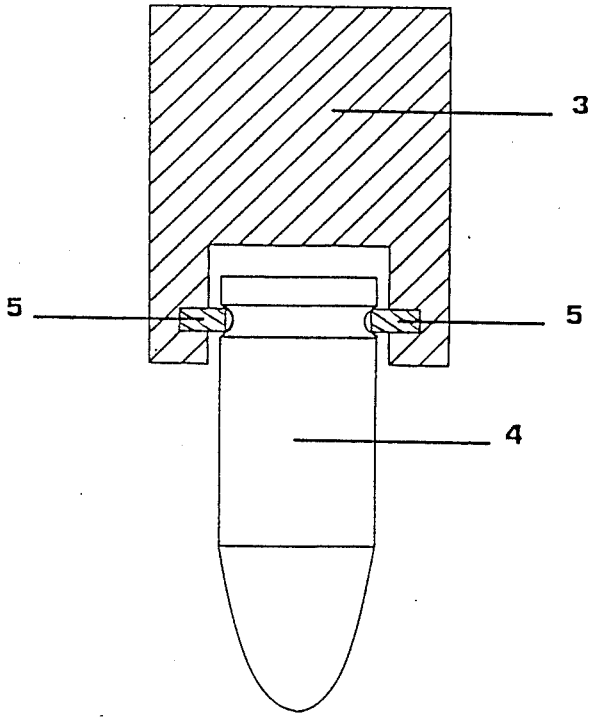
fig. 5
fig. 6
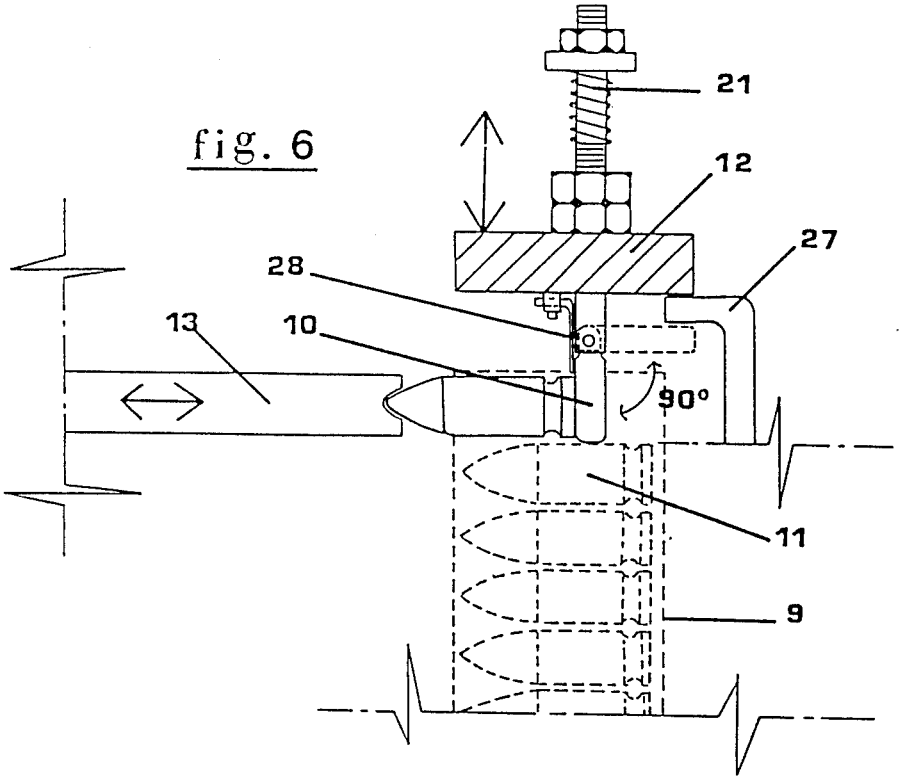

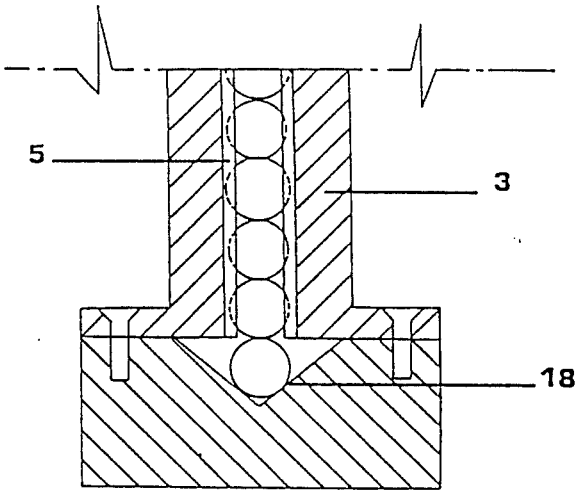
fig. 7
fig. 8
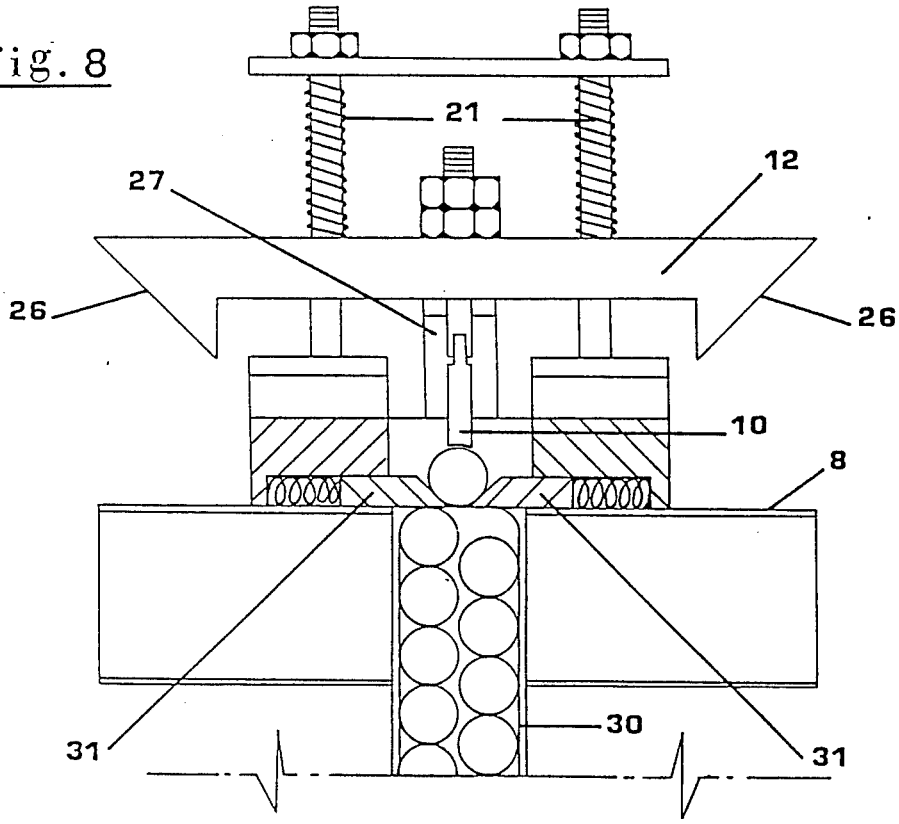

AUTOMATIC DEVICE FOR THE INTRODUCTION OF CARTRIDGES IN ARM MAGAZINES

The present invention concerns an automatic device with an interchangeable interface for the introduction of cartridges into bifilar and monofilar magazines of automatic and semi-automatic arms.

It is well known that the use of drill or professional arms continuously shows the need of refilling the magazines. This need, up to now, was solved by the completely manual cartridge introduction, or by small apparatuses being manually operated, or also by machines being limited to the filling of bifilar magazines.

It is the aim of the present invention to make the above operation completely automatic, so as to obtain the refilling in a very quick time, and in an easy and not expensive manner.

The aim set forth is achieved by means of the device according to the present invention, comprising a plate with a cartridge-guide ledge placed above a vertical track, for transferring said cartridges into a suitable seat, from which a piston introduces the same, one by one, in the arm magazine contained in the interchangeable interfaces, by means of a movable pin.

The present invention will be described more in detail hereinbelow according to the attached drawings, showing one preferred embodiment thereof.

FIG. 5, shows a cross section of the vertical track;

FIG. 6, shows the detail of the movable pin that rotates or pivots approximately 90°;

FIG. 7, shows a cross section of the seat into which the cartridges fall;

FIG. 8, shows a cross section of the interface for bifilar magazines provided with movable inclined planes.

Figure 1:
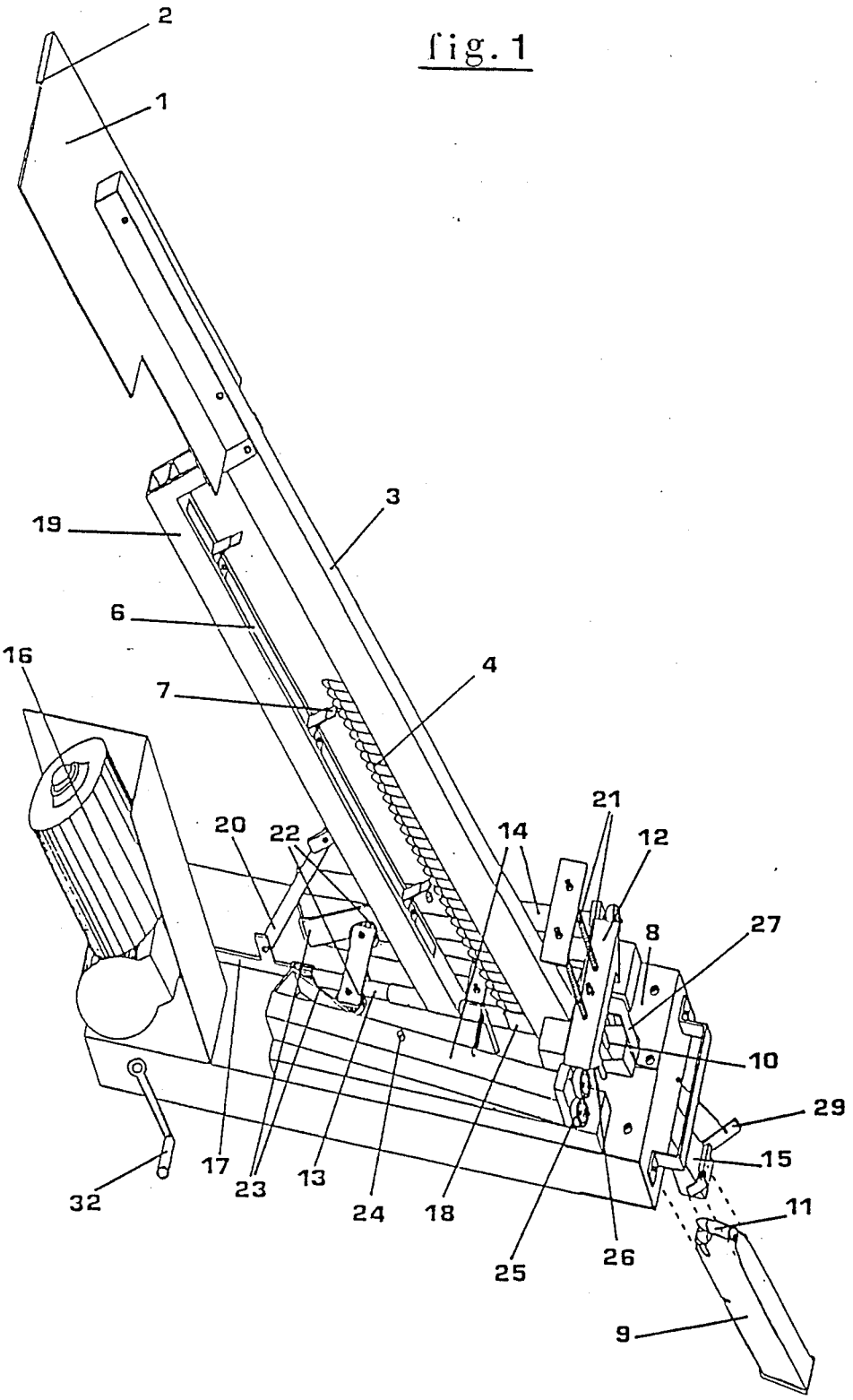
FIG. 1, shows an axonometric view of the whole device.
Figure 2:
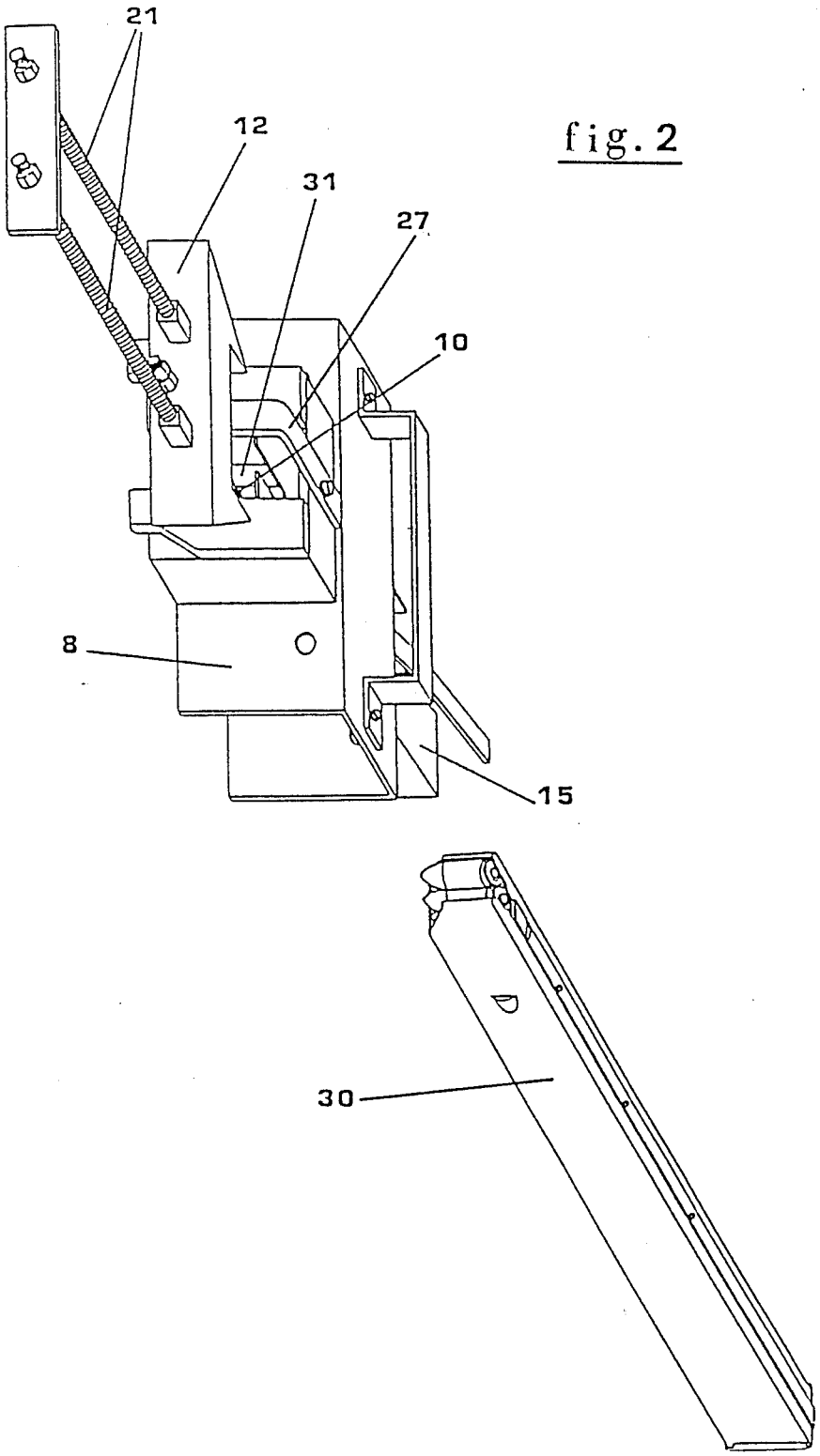
FIG. 2, shows an axonometric view of an interface for bifilar magazines.
Figure 3:
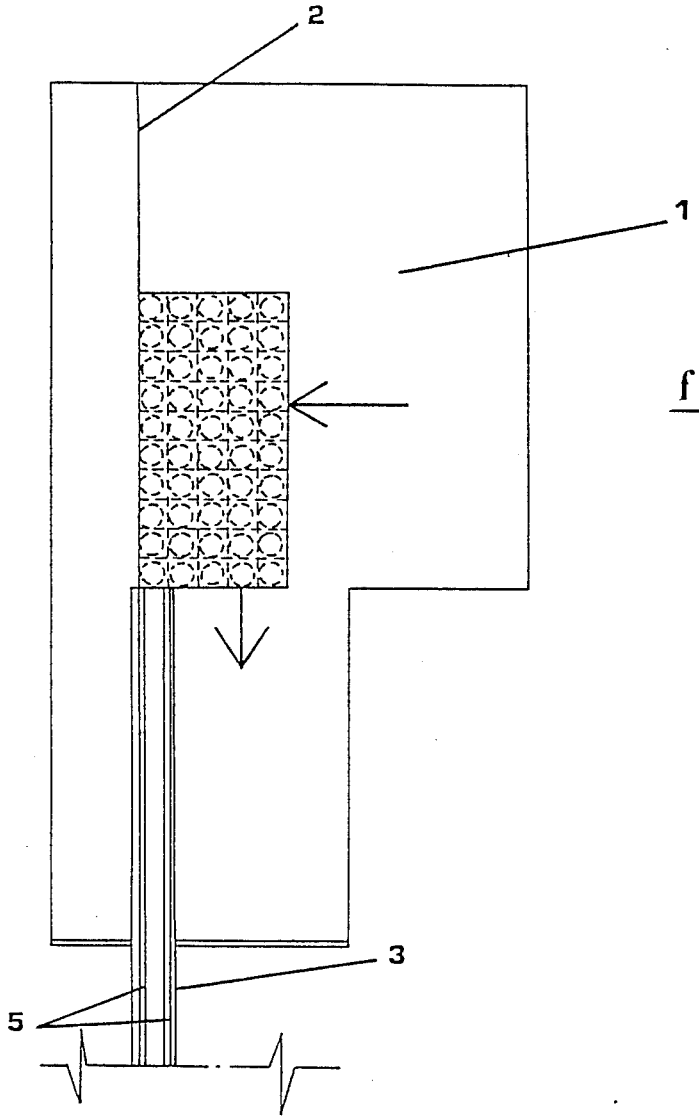
FIG. 3, shows a front view of the plate with a cartridge-guide ledge.
Figure 4:
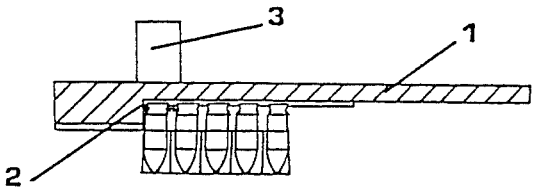
FIG. 4, shows a cross section of the plate with a cartridge-guide ledge.

Relating now to the details of the figures, the device consist of:

a plate 1 with a cartridge-guide ledge 2;

a vertical track 3 from which the cartridges 4 come down making use of guides 5 that will get inserted in the cavity placed near the bottom of the cartridge, said cavity being provided for allowing the extraction of the same cartridge from a firearms cartridge room;

a vertical rod 6 with alternate movement with flexible tabs 7 that graze the noses of cartridges 4, so as to facilitate the sliding in track 3;

an interface 8, interchangeable according to the kind of arm magazine to be filled;

a movable pin 10 provided so that it may perform a 90° revolution (i.e., rotate or pivot at a right angle) and that pushes down the cartridges 11 already contained in the magazine, exploiting the alternate movement of a press (12);

a piston 13 having the task of inserting in succession the cartridges into the arm magazine;

two arms 14 for lifting the press 12 and the pin 10;

a housing 15 for the arm magazine;

an electric motor 16 that has the task of transmitting the movement to the piston 13 with a connecting rod-handle system 17 that is able to transform the rotating into alternate movement.

The plate 1 provided with cartridge-guide ledge 2 is placed above vertical track 3 and allows the introduction of cartridges in said track using directly the cartridge boxes (containing, e.g., 50 cartridges), in which the cartridges are placed with the bottom upwardly turned. The cartridges contained in the box are placed by the operator with the bottom onto plate 1, and dragged towards the cartridge-guide ledge 2 until the first row of cartridges doesn't lean against said ledge. Now the box containing the cartridges is let down so as to allow guides 5, placed along vertical track 3, to get inserted into the cavity placed near the bottom of the cartridges, so as to engage the first row of cartridges. The box containing the remaining cartridges is taken away from the plate and the operation is repeated for each row, until the box is empty.

From plate 1 the cartridges get down directly into the vertical track 3, provided by guides 5, for transferring each single cartridge into the suitable seat 18, from which piston 13 introduces the same into the arm magazine inserted in housing 15.

The cartridges come down along guides 5 of track 3 due to the force of gravity and also due to the help of flexible tabs 7 that graze the nozes and that are placed on vertical rod 6 and provided with alternate movement, inside the prismatic guide 19, by means of the connection of rod 17 with rod 20.

In the filling movement of the small-mouth arm magazine of the monofilar kind the cartridge, passing through the seat 18 under the push of piston 13, before entering completely into the arm magazine 9, meets the lower part of a movable pin 10, that keeps the cartridges already inserted in the arm magazine in a pushed position, and makes the lower part of the pin perform a 90° revolution (i.e., rotate or pivot at a right angle) for finding the space for getting completely introduced into said magazine. The pin 10 is fixed to the press 12 and keeps the cartridges pushed inside the magazine due to the push performed by springs 21 onto press 12.

In the return movement, said piston 13 steps back making a new cartridge fall from track 3 into seat 18 while, at the same time, it makes arms 14 open backwards, exploiting the sliding of wheels 22 onto inclined planes 23. Said arms 14, fixed at the centre of their length by means of pins 24, get closed at the opposite ends, thus forcing the press to lift, exploiting the sliding of wheels 25 on the inclined planes 26 of said press 12, thus charging the springs 21.

Thus pin 10, joint with press 12, gets lifted and, at the same time, it finds an obstacle in a small fixed tooth 27 that forces the lower part of said pin to return into its initial right position and perpendicular to the cartridge just introduced in the arm magazine, so as to repeat the operation. The vertical position of the pin is favoured by the force performed by the blade spring 28 onto the lower part of said pin.

The arm magazine 9 is inserted in the opposite housing 15 and kept in position due to a release lever closing.

The whole system is placed into movement by the electric motor 16 connected to piston 13 by means of the connecting rod-handle system 17.

In the refilling motion of the large mouth arm magazine of the bifilar kind 30, the cartridge that has come down from track 3, passes through seat 18 under the push of piston 13, meets the lower part of a movable pin 10 and makes the same perform a revolution of 90° (i.e., rotate or pivot at a right angle), but doesn't directly enter in the arm magazine and rests on the two horizontally movable inclined planes 31, placed above the magazine 30, whereby said planes, at the following tour, are opened due to the push performed by the pin onto the cartridge previously placed, thus facilitating the introduction of the same in the arm magazine 30.

In the return motion, the working of the variant of the bifilar arm magazine is identical to the one already described for the monofilar arm magazine.

The same automatic device with interchangeable interface for the introduction of the cartridges in the bifilar and monofilar arm magazines of automatic and semiautomatic arms, may be used also in places where no electric energy is available, as it is possible to assure the functioning by means of a manually operated handle 32, to be directly connected to the connecting rod-handle system 17.

I claim:

1. An automatic device for introducing cartridges into bifilar and monofilar magazines of automatic arms, comprising:

a plate having a cartridge-guide ledge;

a vertical track having guides for guiding the cartridges down said track;

a vertical rod for facilitating sliding of the cartridges along said track;

an arm magazine, positioned near the bottom of said track, having a cavity for receiving the cartridges;

an interface and housing for holding said magazine;

a movable pin for downwardly pushing cartridges already contained in said magazine;

a press for biasing said movable pin;

a piston for inserting the cartridges, in succession, into said magazine; and arms for lifting said press and said pin.

2. A device according to claim 1 wherein said vertical track guides the cartridges into a seat and said piston inserts the cartridges from said seat into said magazine inserted in said housing.

3. A device according to claim 1 wherein said vertical rod has flexible tabs for grazing the noses of the cartridges and facilitating sliding of the cartridges along said track.

4. A device according to claim 2 wherein said piston pushes each cartridge into contact with the lower part of said movable pin, the lower part of said movable pin contacting and keeping already inserted cartridges pressed in said magazine, the lower part of said movable pin pivoting at an approximate ninety degree angle to provide a space for introducing the cartridge into said magazines, and said movable pin being adapted to lift so that a small fixed tooth can force said pin back into its original position perpendicular to the cartridge just inserted into said magazine.

5. A device according to claim 4 wherein said piston, in its return stroke, allows a new cartridge to fall into said seal, while simultaneously causing ends of said arms to open by means of wheels mounted on said piston sliding on inclined planes mounted on said arms, said arms being hinged at the centre of their length, and causing opposite ends of said arms to close to force wheels mounted on said opposite ends to slide on inclined planes of said press and lift said press.

6. A device according to claim 1 wherein said magazine is inserted and positioned in said housing by closing a release lever.

7. A device according to claim 1 wherein said piston is automatically operated by an electric motor or manually operated by a handle.

8. A device according to claim 7 wherein said interface is interchangeable according to the kind of arm magazine to be refilled.

* * * * *